United States Patent [19]

Burnett

[11] 4,400,850

[45] Aug. 30, 1983

[54] FOREIGN OBJECT DETECTOR FOR PROTECTION OF CARDING MACHINES

[75] Inventor: James H. Burnett, Greenville, S.C.

[73] Assignee: Herman E. Cox, Greenville, S.C.

[21] Appl. No.: 353,167

[22] Filed: Mar. 1, 1982

[51] Int. Cl.[3] ..... D01G 15/02

[52] U.S. Cl. ..... 19/0.23; 19/105

[58] Field of Search ..... 19/0.2, 0.23, 65 CR, 19/105

[56] References Cited

U.S. PATENT DOCUMENTS

| | | | |
|---|---|---|---|
| 2,086,308 | 7/1937 | Hille et al. | 19/105 |
| 2,734,335 | 2/1956 | Saunders et al. | 19/0.23 X |
| 3,092,875 | 6/1963 | McLean | 19/0.23 |
| 3,889,318 | 6/1975 | Leinek et al. | 19/105 |
| 4,030,635 | 6/1977 | Hablützel et al. | 19/105 X |
| 4,257,147 | 3/1981 | Moss | 19/105 X |

*Primary Examiner*—Louis Rimrodt
*Attorney, Agent, or Firm*—B. P. Fishburne, Jr.

[57] ABSTRACT

A mechanical foreign object detector upstream from the feed roll of a carding machine faithfully detects minute hard objects in the lap which could damage the lickerin or other components of the card. Spring-loaded detector pins penetrate through the lap and contact foreign objects on an apertured plate beneath the lap. Such pins rise and contact a wire connected in a stop motion circuit which immediately stops the operation of the doffer and the feed roll before any damage can occur. A visual and/or audible indicator alerts the operator to the presence of a foreign object or objects which the operator removes by hand before restarting the card by operation of a key-operated reset switch in the circuit. The mechanical detector apparatus includes a power drive which is synchronized with the operation of the feed roll of the card.

8 Claims, 9 Drawing Figures

FIG. 3
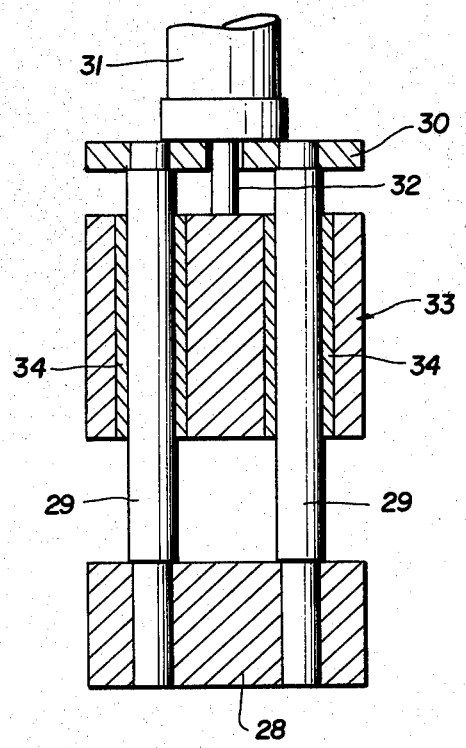
FIG. 4
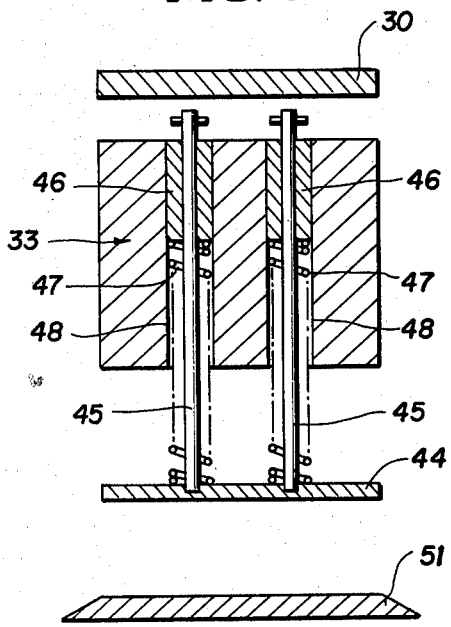
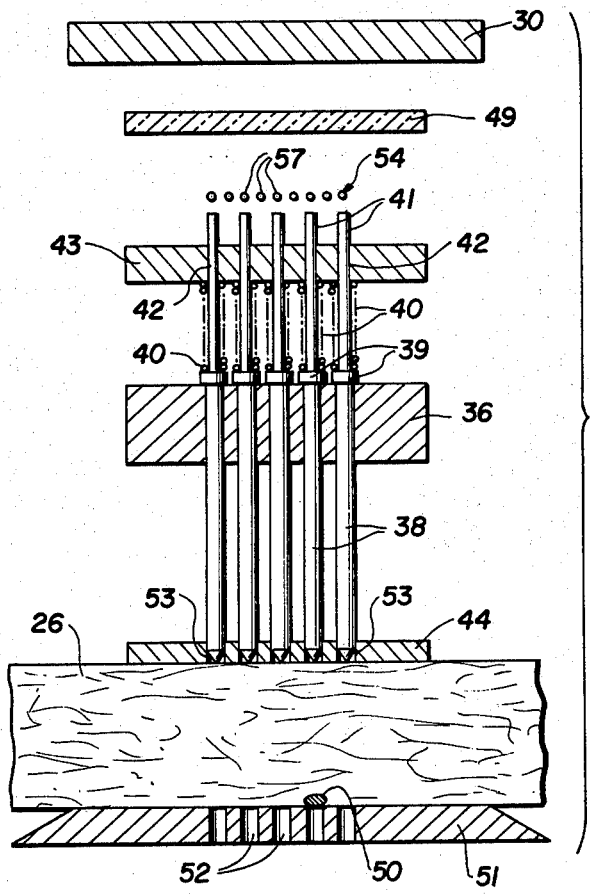
FIG. 5

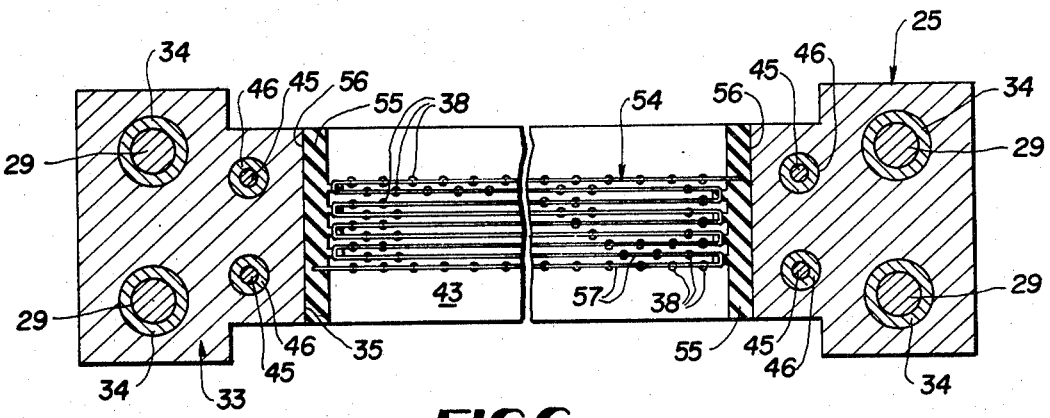
FIG. 6
FIG. 9
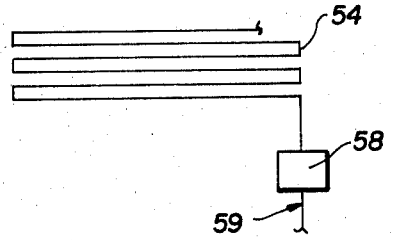
FIG. 7
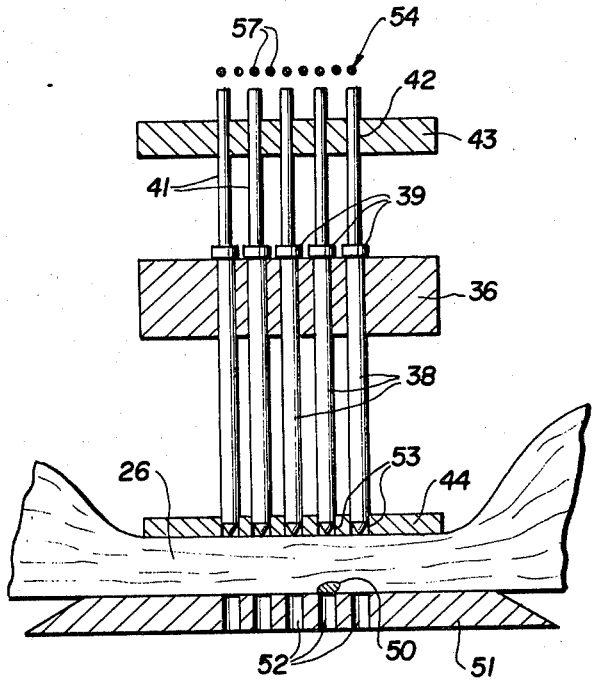
FIG. 8
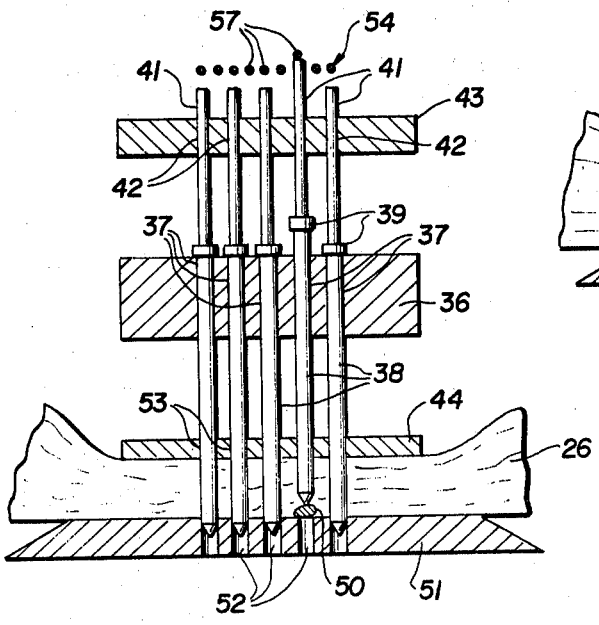

FOREIGN OBJECT DETECTOR FOR PROTECTION OF CARDING MACHINES

BACKGROUND OF THE INVENTION

In the past, various types of metal detectors, magnets, microswitches and eddy current devices have been utilized to protect the carding machine from damage due to foreign objects being present in the lap being fed into the card. All of these devices have fallen far short of desired goals, and the use of some of the devices installed at or under the feed roll of the card have resulted in more costly damage than they prevent. Other devices will only detect metal and will not detect nonferrous metals or other hard materials capable of damaging the card. Such materials include glass, rock, wood, plastics, leather and the like. Damage from such foreign objects can necessitate costly repairs or rebuilding of the card, as is well known.

The object of this invention, therefore, is to provide a foreign object detector which can detect minute objects having a thickness of as little as 0.001 inch with a lateral dimension of about 3/32 inch, regardless of the material the hard object is made of. Furthermore, the mechanical detector can act twice or more on every advancing region of the lap before the lap enters the feed roll. Individual foreign object feeler pins compactly arranged in staggered relationship in multiple rows assure that no foreign objects in the lap will escape detection. When such an object, or objects are detected by the mechanism, the doffer and feed roll will be stopped automatically and cannot be restarted by the operator until the foreign object is removed from the lap, thus assuring complete protection of the card. An indicator is included in the device to alert the operator to the presence of foreign objects and a convenient viewing panel is provided through which the operator can directly observe which feeler pin have been elevated by contact with a foreign object.

The operational capability of the invention in protecting the card is far in excess of any known prior art system.

Other features and advantages of the invention will become apparent during the course of the following detailed description.

BRIEF DESCRIPTION OF THE DRAWINGS

FIG. 3 is a vertical section taken on line 3—3 of FIG. 2.

FIG. 4 is a similar section taken on line 4—4 of FIG. 2.

FIG. 5 is a similar section taken on line 5—5 of FIG. 2 and showing an uncompressed lap passing through the detector mechanism.

FIG. 6 is a fragmentary horizontal section taken on line 6—6 of FIG. 2.

FIG. 7 is a view similar to FIG. 5 showing the lap compressed during operation of the detector mechanism.

FIG. 8 is a similar view showing the feeler or detector pins penetrating the lap with at least one such pin contacting a foreign object and being elevated thereby.

FIG. 9 is a fragmentary schematic view of a control circuit.

DETAILED DESCRIPTION

Figure 1:
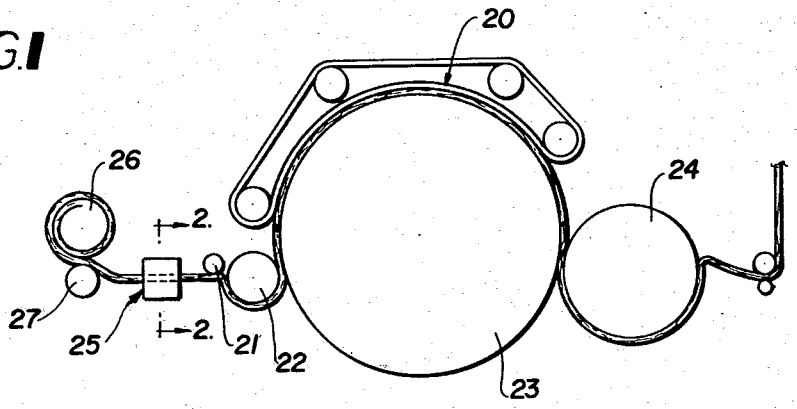
FIG. 1 is a schematic side elevation of a card equipped with a foreign object detector in accordance with the invention.

Referring to the drawings in detail and referring first to FIG. 1, a conventional revolving-top flat card 20 is shown having a feed roll 21, lickerin 22, card cylinder 23 and doffer 24. The foreign object detector 25 forming the subject matter of the invention is positioned in FIG. 1 just upstream from the feed roll 21 to protect the feed roll, the lickerin and the entire card from foreign object damage which would occur with costly results if an effective detector means were not present. FIG. 1 also shows the coiled lap 26 and lap roll 27 ahead of the detector 25. While a lap feeding card has been illustrated, the invention is also applicable to chute feed cards merely by altering the mode of operation of two pneumatic cylinders which coordinate the operation of the detector with the operation of the card, as will be further discussed.

Continuing to refer to the drawings, the detector apparatus 25 comprises bottom spaced mounting blocks 28 which rest on a solid support surface. The spacing of these blocks is sufficient to accommodate the full width of the lap 26 which measures about 40 inches on a standard size card. Such lap, before compression, FIG. 5, is about 3 inches thick and when compressed in the detector apparatus, FIG. 7, is about 1 inch thick. The blocks 28 support vertical guide posts 29 arranged in fore and aft parallel pairs, FIG. 3, in turn supporting a top plate 30 at their upper ends to which are suitably attached two vertical axis pneumatic cylinders 31 having depending piston rods 32.

The piston rods 32 are suitably secured to a feeler pin carriage bar 33 having guide bushings 34 therein which slidably engage the parallel posts 29. The carriage bar has a top opening cavity 35 formed therein providing a relatively thin bottom wall portion 36 on the carriage bar having plural rows of parallel equidistantly spaced apertures 37 formed therethrough across the full width of the cavity 35. As shown in FIGS. 7 and 8, preferably five equidistantly spaced parallel rows of the apertures 37 are provided in the wall portion 36 and the apertures of adjacent parallel rows are staggered laterally relative to each other, as shown in FIG. 6, to provide a rather high density of apertures and of the feeler pins 38 which are slidably mounted therein on parallel vertical axes.

The feeler pins 38 have heads 39 adapted to rest on the upper surface of plate portion 36 under influence of downwardly biasing springs 40 which surround reduced upper stems 41 of the feeler pins 38 and engage slidably through apertures 42 of a spring tension plate 43 suitably fixed in the cavity 35 above and parallel to the wall portion 36.

A lap compression plate and feeler pin cleaner 44 disposed substantially below the feeler pin carriage bar 33 in parallel relation thereto is supported by two pairs of parallel rods 45 near opposite ends thereof, such rods extending upwardly through guide bushings 46 fixed within openings of the carriage bar 33. The lap compression plate 44 is biased donwardly by lap compression springs 47 which surround the rods 45 and have their lower ends bearing on the plate 44 and their upper ends engaging the bushings 46 within spring receptor cavities 48 of carriage bar 33.

The top of cavity 35 is covered by a transparent cover plate 49 which enables the operator to have a clear view of the tops of the detector or feeler pins so that he can determine exactly where a detected foreign object 50 or objects, in the lap 26, is located, FIG. 8.

Below the lap compression plate and feeler pin cleaner 44 in parallel relationship thereto is a stationary ramp plate 51 over which the lap 26 passes, as shown in the drawings. This ramp plate has rows of apertures 52 formed therethrough which are coaxially aligned with apertures 53 of the lap compression plate and with the pointed pins 38. The ramp plate 51 is attached fixedly to the support surface on which the blocks 28 are based.

Figure 2:
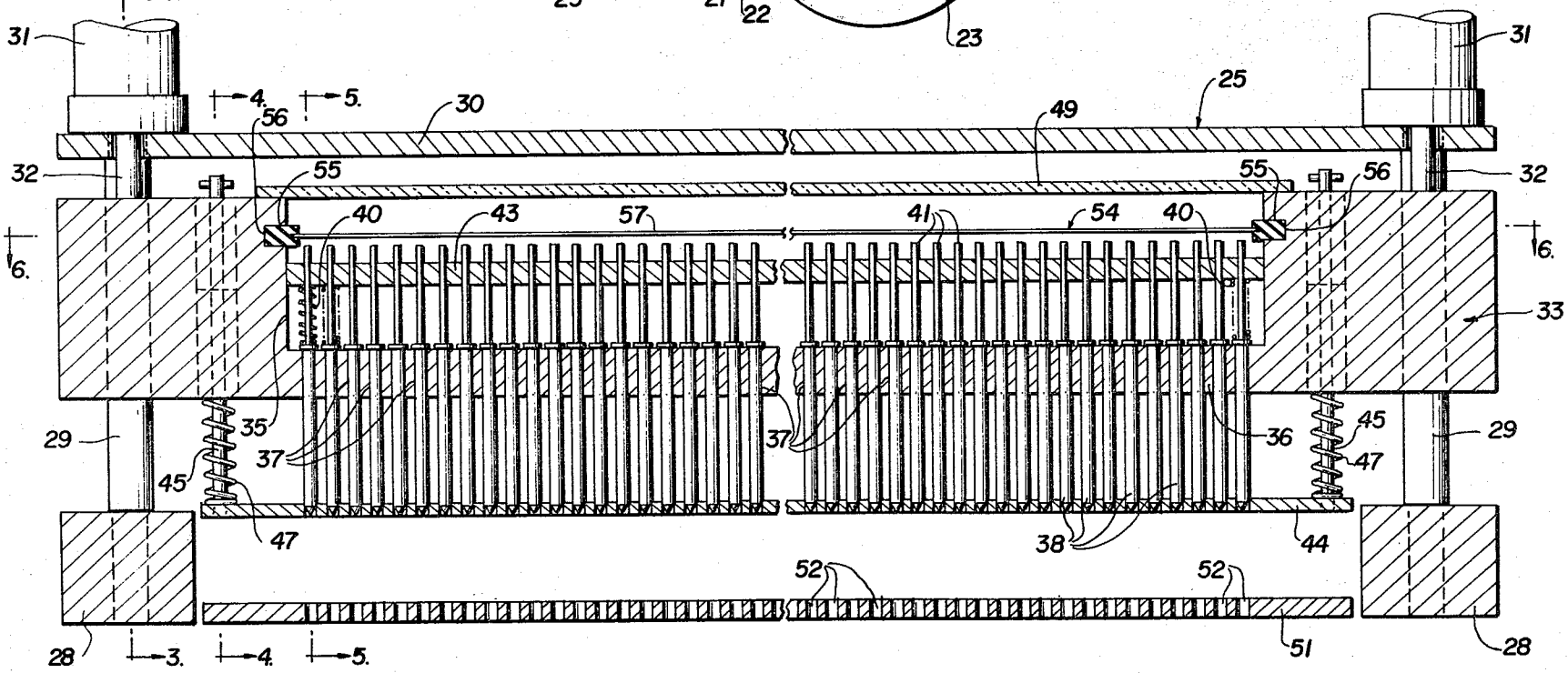
FIG. 2 is a fragmentary transverse vertical section through the mechanical detector device taken on line 2—2 of FIG. 1.

The apparatus further comprises an electrical grounding wire 54 lying in a horizontal plane near and above the tops of feeler pin extensions 41, FIG. 2. This wire is laced back and forth between two lacing bars 55 formed of electrical insulating material held in grooves 56 provided in the carriage bar 33. The continuous wire 54 is bodily supported on the insulating bars 55 and thus electrically isolated from the metal carriage bar 33. It comprises spaced parallel branches 57 with one such branch extending directly above and along each row of the feeler pin extensions 41. Hence, whenever one or more of the pins 38 in any row of pins rises due to contact with a foreign object 50, FIG. 8, the extension 41 or extensions will engage one of the strands or branches 57 of grounding stop motion wire 54.

As shown schematically in FIG. 9, the wire 54 is connected with a suitable circuit interrupter 58 forming a component of a conventional stop motion circuit 59. Whenever contact between the wire 54 and one or more of the pin extensions 51 occurs, the stop motion circuit will be broken and the operation of the card feed roll 21 and doffer 24 will be stopped. When stopped, the operator can observe through the transparent plate 49 which feeler pin or pins are elevated due to contact with an object 50 and the operator will then manually handle the lap 26 and remove the foreign object before restarting the card by utilizing a preferably key-operated reset switch in the stop motion circuit.

The exact configuration of the circuitry can vary considerably within the state of the art, and the details of circuitry are believed to be unimportant and unnecessary to disclose for a proper understanding of this invention. For example, the circuit may include an indicator light bulb and/or an audible signal to alert the operator to the detection of foreign objects. It may also include a burned out light bulb sensor and other state of the art components.

In the case of a lap feeding card 20, as shown in FIG. 1, the pneumatic cylinders 31 are single reverse-acting gravity extending cylinders. When the invention is applied to a chute feed card, the two cylinders are of the double-acting type. State of the art controls for the cylinders 31, not shown, synchronize their operation with the operation of the card. Preferably, the feeler pin carriage bar 33 reciprocates two or more times to push the pins 38 through the lap at each area of the lap spanned by the detector mechanism. Each penetration of the lap and compression thereof by the plate 44 is momentary, for about 1/10 of a second. The lap has its fibers loosely arranged and is slowly moving and therefore the repeated penetrations of the lap by the feeler pins does not effect the lap movement or the normal operation of the card.

Each time the carriage bar 33 descends, the compression plate 44 will compress the lap 26 to a thickness of approximately 1 inch and the springs 47 will yield to prevent further compression. The multiple pins 38 will now penetrate entirely through the lap and will enter the apertures 52 of the fixed ramp plate 51, as shown in FIG. 8. This assures detection of any foreign object at the very bottom of the lap. On the rise of the carriage bar 33 as pins 38 leave the top of the lap, they are stripped clean by the apertures 53 while the compression plate 44 is held down by the springs 47, following which the plate 44 will rise with the bar 33 and the parts ultimately return to their relative positions shown in FIGS. 2 and 5.

The apertures 52 of ramp plate 51 are sized to prevent passage therethrough of the smallest foreign objects 50 which are necessary to detect, namely, objects having a width measurement horizontally of about 3/32 inch. As shown in FIG. 5, the apertures 52 will also center and stabilize objects 50 on the ramp plate so that they will not escape detection by the feeler pins. The arrangement is such that the device is capable of detecting almost all potentially damaging foreign objects in the lap to protect the card and without interfering with its normal operation.

Other state of the art features not shown can and are preferably included in the device. Such features include a flow control valve in the pneumatic circuit of cylinders 31 to regulate the gravitational fall of carriage bar 33 when one-way pneumatic cylinders are employed with lap feed cards. A manual two position valve can also be provided to enable the operator to manually raise the carriage bar in preparation for removing foreign objects by hand from the lap after they have been detected.

The numerous advantages of the invention over the prior art should be readily apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. For use with a carding machine to protect such machine from damage caused by the presence of hard foreign objects in the lap entering the machine, a foreign object detector adapted for placement near and in advance of the feed roll of a carding machine, said detector comprising a vertically reciprocatory carriage member, a stationary apertured ramp plate below said carriage member in spaced relationship thereto and defining a surface over which a lap must pass entering the carding machine, an apertured spring-loaded lap compression plate bodily carried by and moving with said carriage member and adapted to engage the lap on the ramp plate and to compress the lap to a fraction of its full thickness, a multiplicity of lap penetrating foreign object detector pins bodily mounted on the carriage member and being individually spring-loaded and having guided registration with apertures of the lap compression plate and being adapted to enter the apertures of the ramp plate below the lap, said detector pins and apertures being provided in a high density array in multiple rows across the path of movement of the latter, power means connected with the carriage member to reciprocate it relative to the lap, and an electrically isolated grounding wire on the carriage member above the tops of the detector pins including spaced parallel branches aligned with said rows of detector pins, and said grounding wire being connected in a stop motion circuit and being operable through such circuit to stop the operation of the carding machine when one or more of said detector pins rises and contacts said wire responsive to engaging a foreign object in said lap and above the ramp plate.

2. For use with a carding machine to protect such machine as defined in claim 1, and fixed upstanding guide post means for the carriage member near opposite sides of the detector and being spaced apart sufficiently to allow passage of the lap therebetween, the ramp plate being disposed between the guide post means, said power means connected with the carriage member comprising at least one fluid pressure operated power cylinder, and said stop motion circuit including a circuit interruptor.

3. For use with a carding machine to protect such machine as defined in claim 1, and guide post means for said apertured spring-loaded lap compression plate on the carriage member adapted to yield when the lap is compressed to a predetermined degree by the lap compression plate thereby allowing full penetration of the lap by said detector pins during further downward movement of the carriage member, and the loading springs of the detector pins yielding to allow upward movement of pins which engage foreign objects in the lap sufficiently to enable upper extensions of the pins to contact said grounding wire.

4. For use with a carding machine to protect such machine as defined in claim 3, and said carriage member comprising a bar member having a cavity formed in its top and across a major portion of its width across the movement path of the lap, said grounding wire being disposed in said cavity above the upper extensions of said detector pins, and lacing supports for the parallel branches of the grounding wire fixed to the opposite side walls of said cavity and supporting said branches in a taut state in a common horizontal plane above the detector pins, said grounding wire branches being vertically aligned above the multiple rows of detector pins.

5. For use with a carding machine to protect such machine as defined in claim 4, and a transparent viewing panel on the carriage member in covering relationship to the cavity, whereby an operator may view the tops of said detector pins in order to notice which pins are elevated into contact with the grounding wire, thereby giving the operator the location of detected foreign objects in said lap.

6. For use with a carding machine to protect such machine as defined in claim 1, and fixed upstanding guide posts for the carriage member on opposite sides of said ramp plate and lap compression plate, a pair of base members for the bottoms of the guide posts on opposite sides of the ramp plate, a top plate interconnecting the guide posts above the carriage member, and a pair of upright axis power cylinders mounted on said top plate and having piston rods connected with the carriage member near opposite ends thereof.

7. A foreign object detector for use in protecting a carding machine from damage caused by the presence of foreign hard objects in the lap entering the machine, said detector comprising fixed guide and support means straddling the path of movement of the lap, reciprocating carriage means on the guide and support means adapted for movement toward and away from a lap, an apertured spring-loaded lap compression plate on the bottom of the carriage means and across the lap to compress the lap on downward movement of the carriage means, power means connected with the carriage means to move it at least in one direction relative to the lap, an apertured ramp member in fixed position below the carriage means and said apertured compression plate, a multiplicity of closely packed parallel axis individually spring-loaded detector pins on the carriage means and depending therefrom and being engaged movably in the apertures of the lap compression plate and adapted to enter the apertures of said ramp member following compression of the lap by the compression plate, and an electrical sensing element on the carriage means above the tops of the detector pins and adapted for contact with one or more of the pins displaced upwardly by contact with a foreign object in the lap, and said electrical sensing element being connected in a card stop motion circuit.

8. A foreign object detector for preventing damage to a carding machine caused by the presence of foreign objects in the lap entering the machine, said detector adapted to be placed astride the lap upstream from the machine feed roll, said detector comprising a power operated reciprocating carriage means above and across the lap including a spring-urged plate to compress the lap and spring-urged lap penetrating detector elements which in penetrating the lap contact hard foreign objects in the lap and are displaced upwardly by such objects, and a carding machine stop motion element on the carriage means above the tops of the detector elements in the path of movement of displaced elements and adapted in response to contact with a displaced detector element to terminate the operation of a carding machine.

* * * * *